US007946142B2

(12) United States Patent
Matyko et al.

(10) Patent No.: US 7,946,142 B2
(45) Date of Patent: May 24, 2011

(54) PADLOCK HASP ASSEMBLY

(75) Inventors: Belo Matyko, Ashdod (IL); Alex Akerman, Rehovot (IL)

(73) Assignee: Mul-T-Lock Technologies Ltd., Yavne (IL)

( * ) Notice: Subject to any disclaimer, the term of this patent is extended or adjusted under 35 U.S.C. 154(b) by 42 days.

(21) Appl. No.: 12/298,160

(22) PCT Filed: Apr. 18, 2007

(86) PCT No.: PCT/IL2007/000486

§ 371 (c)(1),
(2), (4) Date: Oct. 23, 2008

(87) PCT Pub. No.: WO2007/122609

PCT Pub. Date: Nov. 1, 2007

(65) Prior Publication Data

US 2009/0095033 A1 Apr. 16, 2009

(30) Foreign Application Priority Data

Apr. 26, 2006 (IL) ..... 175231

(51) Int. Cl.
*E05B 67/22* (2006.01)

(52) U.S. Cl. ..... 70/34; 70/2; 70/104; 292/302

(58) Field of Classification Search ..... 70/33, 34, 70/104, 158, 163, 166, 169, 2, 54–56, 225, 70/226, 233; 292/302, 327
See application file for complete search history.

(56) References Cited

U.S. PATENT DOCUMENTS

| | | | | |
|---|---|---|---|---|
| 4,183,235 | A | 1/1980 | Brunelli et al. | |
| 4,567,740 | A * | 2/1986 | Kelly | 70/55 |
| 5,255,542 | A * | 10/1993 | Fortin | 70/34 |
| 5,442,941 | A * | 8/1995 | Kahonen et al. | 70/34 |
| 5,544,506 | A * | 8/1996 | Nakano | 70/34 |
| 5,875,658 | A * | 3/1999 | Lahtinen et al. | 70/34 |
| 5,941,102 | A * | 8/1999 | Reinholdsson et al. | 70/34 |
| 5,987,939 | A * | 11/1999 | Pitisettakarn | 70/33 |
| 6,036,240 | A * | 3/2000 | Hamilton et al. | 70/104 |
| 6,464,269 | B1 * | 10/2002 | Wilhelm et al. | 70/34 |
| 6,574,999 | B2 * | 6/2003 | Chen | 70/33 |
| 7,076,976 | B1 * | 7/2006 | Goldman | 70/33 |
| 2004/0031298 | A1 * | 2/2004 | Lai | 70/33 |
| 2005/0172681 | A1 | 8/2005 | Tonelli | |

FOREIGN PATENT DOCUMENTS

| | | |
|---|---|---|
| EP | 0104939 | 4/1984 |
| FR | 2726313 | 5/1996 |
| GB | 2349168 | 10/2000 |
| WO | 97/09502 | 3/1997 |

* cited by examiner

*Primary Examiner* — Suzanne D Barrett
*Assistant Examiner* — Christopher Boswell
(74) *Attorney, Agent, or Firm* — Dekel Patent Ltd; David Klein

(57) ABSTRACT

A padlock hasp assembly including a first hasp member (12) and a second hasp member (14) including interface contours including complimentary shaped protrusions and recesses that mate with one another, and a locking assembly housed in the first hasp member (12), the locking assembly including a cylinder lock (10) including a tumbler adapted to bring a locking element into locking engagement with a notch formed in a locking bolt (16), the locking bolt (16) being arranged for sliding motion through a first bore formed in the first hasp member, and when the second hasp member (14) is aligned with the first hasp member (12), the locking bolt (16) is slidable into a second bore formed in the second hasp member (14) so as to lock the first and second hasp members (12, 14) together.

9 Claims, 2 Drawing Sheets

PADLOCK HASP ASSEMBLY

FIELD OF THE INVENTION

The present invention relates generally to high security padlocks and particularly to a high security padlock with lockable hasp assembly.

BACKGROUND OF THE INVENTION

Many high security padlocks are commercially available. For example, Mul-T-Lock Ltd. produces C-Series Padlocks that include a single pin, for general use with commercially available hasps or heavy duty chains which accept 13 mm pins.

Padlocks that have protected hasps are also known. For example, U.S. Pat. No. 4,548,058 to Bahry and Dolev describes a padlock assembly in which each side of a door opening, e.g., a hinged door and a jamb, or two sliding doors, is provided with a protective hasp for a lock body and shackle of a lock. Each half of the hasp is so formed that, when mated, as on joining of the doors or closing of the doors, provisions are made for insertion of a lock body into the protective hasp, and insertion of a shackle through the hasp and the lock body to lock the closure. More specifically, the padlock assembly includes two complementary shells, which when abutting each other, enclose the entire padlock. Each shell has an opening from the top for the insertion of one leg of the shackle, and a larger opening from the bottom to house the lock body when the shells abut against each other. The shells provide the attachment means for the padlock on the door and jamb.

SUMMARY OF THE INVENTION

The present invention seeks to provide an improved padlock including a hasp assembly with a locking mechanism, having members that are lockable together, as described more in detail hereinbelow.

It is noted that the term "door" as used throughout the specification and claims encompasses any kind of door, window, gate or panel, for example.

There is thus provided in accordance with an embodiment of the present invention a padlock hasp assembly including a first hasp member and a second hasp member including interface contours including complimentary shaped protrusions and recesses that mate with one another, and a locking assembly housed in the first hasp member, the locking assembly including a cylinder lock including a tumbler adapted to bring a locking element into locking engagement with a notch formed in a locking bolt, the locking bolt being arranged for sliding motion through a first bore formed in the first hasp member, and when the second hasp member is aligned with the first hasp member, the locking bolt is slidable into a second bore formed in the second hasp member so as to lock the first and second hasp members together. The locking element may be movable into locking engagement with a second notch formed in the locking bolt so as to prevent moving the locking bolt completely out of the first hasp member.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
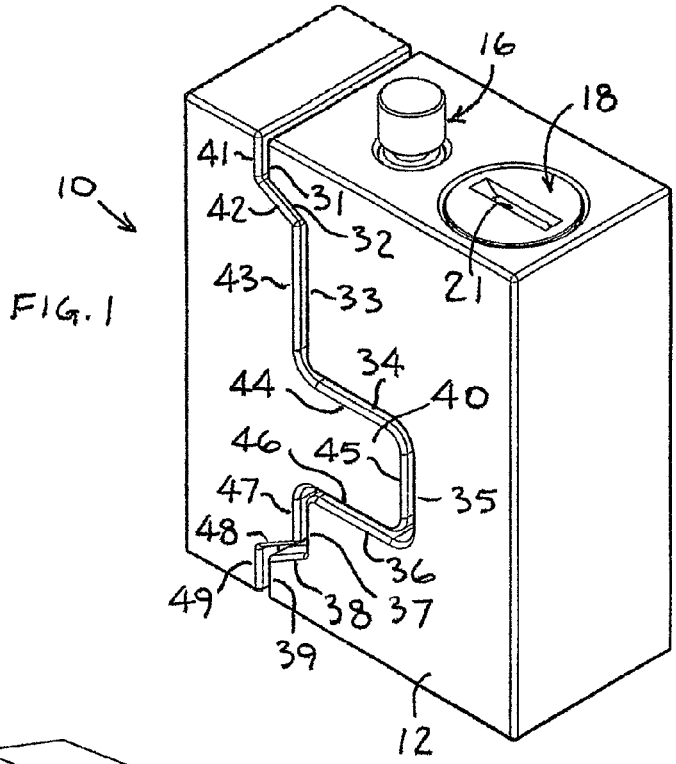
FIGS. 1 and 2 are simplified pictorial illustrations of a padlock hasp assembly, constructed and operative in accordance with an embodiment of the present invention.
Figure 2:
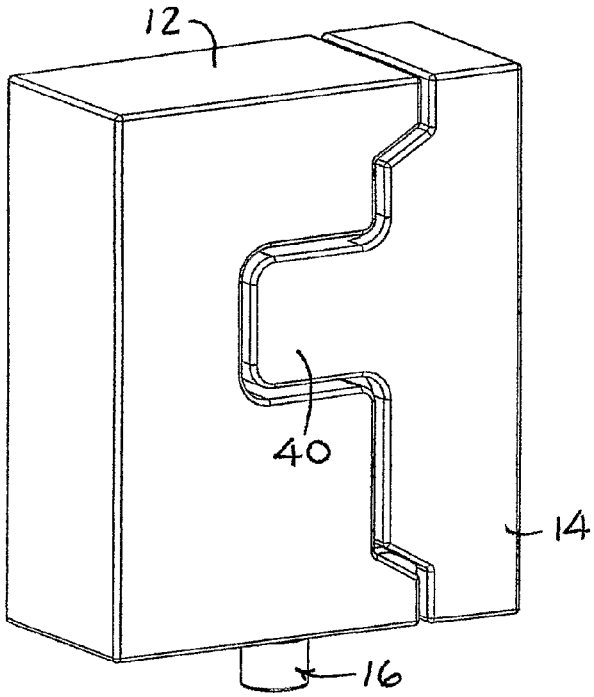
Figure 3:
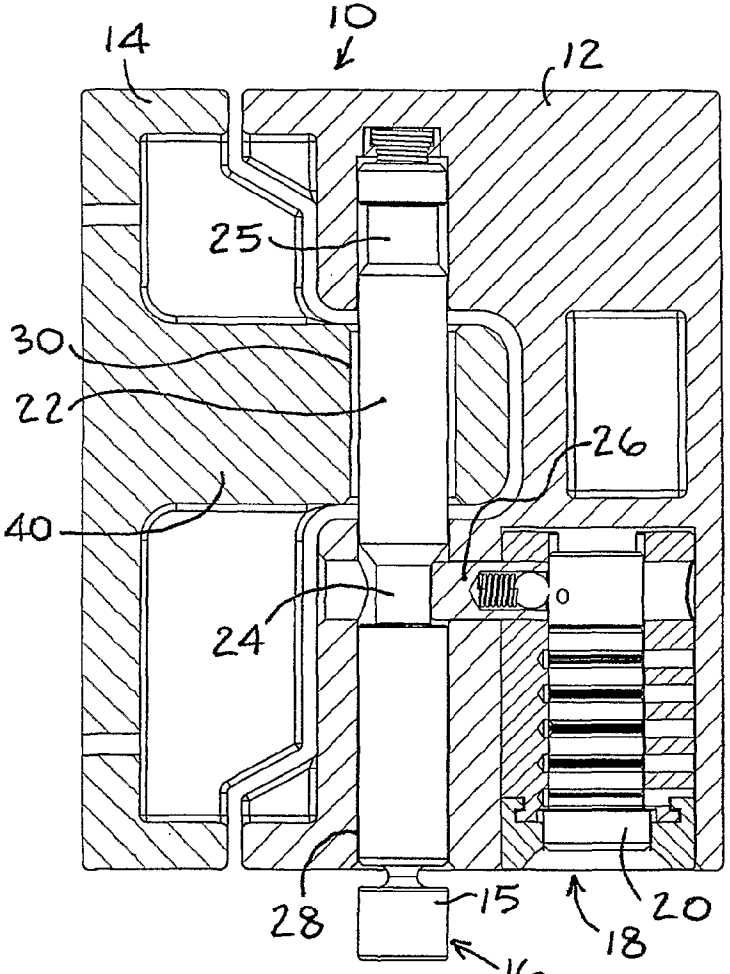
FIG. 3 is a simplified partially sectional illustration of inner locking components of the padlock hasp assembly of FIGS. 1 and 2.

Reference is now made to FIGS. 1-3, which illustrate a padlock hasp assembly 10, constructed and operative in accordance with an embodiment of the present invention.

Padlock hasp assembly 10 may include a first hasp member 12 and a second hasp member 14. The first hasp member 12 may house a locking assembly that includes a locking bolt 16 that may pass through a portion of second hasp member 14 so as to lock the two hasp members together. The hasp members 12 and 14 and locking bolt 16 may be constructed of any suitable material, such as but not limited to, hardened steel alloy. Locking bolt 16 may include a head 15 that may have a narrow neck portion for shearing off upon attempted tampering therewith.

The locking assembly may include a cylinder lock 18, such as but not limited to, a Mul-T-Lock high precision telescopic pin tumbler system, which may be pick and drill resistant for high security needs. As is well known in the art, cylinder lock 18 may include a tumbler or plug 20 which may be rotated by means of an authorized key (not shown) inserted in the keyway 21 (FIG. 1) of plug 20. Locking bolt 16 may include a generally cylindrical shank 22 with a first notch 24 and a second notch 25 formed therein. A locking element 26 may be brought into and out of locking engagement with first notch 24 by rotating plug 20, as is known in the art. Locking bolt 16 may be arranged for sliding motion through a first bore 28 formed in first hasp member 12. When the second hasp member 14 is aligned with the first hasp member 12, locking bolt 16 may pass through a second bore 30 formed in second hasp member 14.

When locking element 26 is moved away from locking element 26 and out of locking engagement with first notch 24, locking bolt 16 may be slid in the direction outwards of first hasp member 12. As long as the portion of shank 22 between first and second notches 24 and 25 slides past locking element 26, the thickness of the shank 22 prevents locking element 26 from moving back inwards. When the second notch 25 moves in alignment with locking element 26, the smaller diameter of second notch 25 permits locking element 26 to move back inwards, thereby locking against second notch 25. This prevents locking bolt 16 from being pulled completely out of first hasp member 12.

The first and second hasp members 12 and 14 may have interface contours including complimentary shaped protrusions and recesses that mate with one another. By "mating with another" it is meant that when the hasp members 12 and 14 are mounted on each side of a door opening, e.g., a hinged door and a jamb, or two sliding doors, the interface contours can mesh together without interference when closing the doors (the locking bolt 16 being in an unlocked position wherein it juts out of first bore 28 and does not interfere with the second hasp member 14), no matter whether the doors are sliding or hinged doors.

The interface contour of first hasp member 12 may include a first straight surface 31 (vertical in the sense of FIG. 1), a second surface 32 extending from and angled at an obtuse angle with first surface 31, a third surface 33 extending from second surface 32 and generally parallel with first surface 31, a fourth surface 34 extending from third surface 33 and generally perpendicular thereto, a fifth surface 35 extending from fourth surface 34 and generally parallel with third surface 33, a sixth surface 36 extending from fifth surface 35 and generally parallel with fourth surface 34, a seventh surface 37 extending from sixth surface 36 and generally collinear with third surface 33, an eighth surface 38 extending from and angled at an obtuse angle with seventh surface 37, and a ninth surface 39 extending from eighth surface 38 and generally collinear with first surface 31.

Similarly, the interface contour of second hasp member 14 may include a first straight surface 41 (vertical in the sense of FIG. 1), a second surface 42 extending from and angled at an obtuse angle with first surface 41, a third surface 43 extending from second surface 42 and generally parallel with first surface 41, a fourth surface 44 extending from third surface 43 and generally perpendicular thereto, a fifth surface 45 extending from fourth surface 44 and generally parallel with third surface 43, a sixth surface 46 extending from fifth surface 45 and generally parallel with fourth surface 44, a seventh surface 47 extending from sixth surface 46 and generally collinear with third surface 43, an eighth surface 48 extending from and angled at an obtuse angle with seventh surface 47, and a ninth surface 49 extending from eighth surface 48 and generally collinear with first surface 41. The corners at adjacent surfaces may be rounded.

Surfaces 44, 45 and 46 define a tongue 40 that mates with a recess defined by surfaces 34, 35 and 36. As mentioned above, locking bolt 16 may pass through second bore 30 formed in second hasp member 14, and second bore 30 passes through tongue 40.

Figure 4:
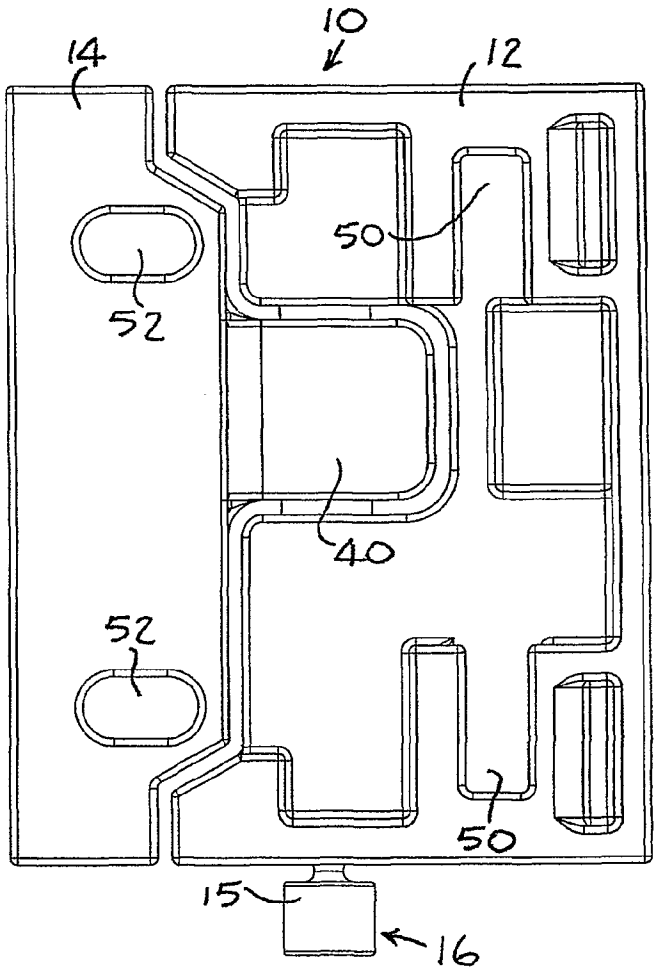
FIG. 4 is a simplified rear-view illustration of the padlock hasp assembly of FIGS. 1 and 2, showing different mounting provisions.

Reference is now made to FIG. 4. Padlock hasp assembly 10 may be welded to mounting surfaces. In addition, padlock hasp assembly 10 may include mounting provisions, such as mounting holes, for attachment to mounting surfaces (e.g., a door or window or any other kind of panel, sliding or hinged.) The mounting provisions may include, without limitation, two elongate mounting grooves or channels 50 formed in first hasp member 12 and two elongate mounting holes 52 formed in second hasp member 14. The elongate mounting provisions 50 may be generally parallel to locking bolt 16 and the elongate mounting provisions 52 may be generally perpendicular to mounting provisions 50. The mounting provisions are suitable for a bolt head to be placed therein, wherein the threaded shank of the bolt protrudes outwards. The bolt head may be prevented from turning by the sides of the elongate mounting provisions.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A padlock hasp assembly comprising:

a first hasp member and a second hasp member comprising interface contours including complimentary shaped protrusions and recesses that mate with one another; and a locking assembly housed in said first hasp member, said locking assembly comprising a cylinder lock including a tumbler adapted to bring a locking element into locking engagement with a first notch formed in a locking bolt, said locking bolt comprising a generally cylindrical shank with said first notch and a second notch formed therein, said locking bolt being arranged for sliding motion through a first bore formed in said first hasp member, and when said second hasp member is aligned with said first hasp member, said locking bolt is slidable into a second bore formed in said second hasp member so as to lock said first and second hasp members together;

wherein said cylinder lock also moves said locking element out of locking engagement with said first notch, so as to permit sliding said locking bolt in a direction outwards of said first hasp member, and wherein as long as a portion of said shank between said first and second notches slides past said locking element, a thickness of said shank prevents said locking element from moving back inwards and when said second notch moves in alignment with said locking element, said second notch permits said locking element to move back inwards, thereby locking against said second notch and preventing said locking bolt from being pulled completely out of said first hasp member.

2. The padlock hasp assembly according to claim 1, wherein said interface contour of said first hasp member comprises a first straight surface, a second surface extending from and angled at an obtuse angle with said first surface, a third surface extending from said second surface and generally parallel with said first surface, a fourth surface extending from said third surface and generally perpendicular thereto, a fifth surface extending from said fourth surface and generally parallel with said third surface, a sixth surface extending from said fifth surface and generally parallel with said fourth surface, a seventh surface extending from said sixth surface and generally collinear with said third surface, an eighth surface extending from and angled at an obtuse angle with said seventh surface, and a ninth surface extending from said eighth surface and generally collinear with said first surface.

3. The padlock hasp assembly according to claim 2, wherein said interface contour of said second hasp member comprises a first straight surface, a second surface extending from and angled at an obtuse angle with said first surface, a third surface extending from said second surface and generally parallel with said first surface, a fourth surface extending from said third surface and generally perpendicular thereto, a fifth surface extending from said fourth surface and generally parallel with said third surface, a sixth surface extending from said fifth surface and generally parallel with said fourth surface, a seventh surface extending from said sixth surface and generally collinear with said third surface, an eighth surface extending from and angled at an obtuse angle with said seventh surface, and a ninth surface extending from said eighth surface and generally collinear with said first surface.

4. The padlock hasp assembly according to claim 3, wherein said fourth, fifth and sixth surfaces of said interface contour of said second hasp member define a tongue that mates with a recess formed in said first hasp member.

5. The padlock hasp assembly according to claim 4, wherein said second bore passes through said tongue.

6. The padlock hasp assembly according to claim 1, wherein elongate mounting provisions are formed in said first hasp member and elongate mounting provisions are formed in said second hasp member.

7. The padlock hasp assembly according to claim 6, wherein said elongate mounting provisions of said first hasp member are generally parallel to said locking bolt.

8. The padlock hasp assembly according to claim 6, wherein said elongate mounting provisions of said second hasp member are generally perpendicular to the mounting provisions of said first hasp member.

9. The padlock hasp assembly according to claim 1, wherein said locking bolt comprises a head with a narrow neck portion for shearing off upon attempted tampering therewith.

* * * * *